US009802095B1

(12) United States Patent
Boyer et al.

(10) Patent No.: US 9,802,095 B1
(45) Date of Patent: Oct. 31, 2017

(54) SWING TRAINING DEVICE

(71) Applicants: Michael D Boyer, Weatherford, TX (US); LeGrand K Malany, Springfield, IL (US)

(72) Inventors: Michael D Boyer, Weatherford, TX (US); LeGrand K Malany, Springfield, IL (US)

( * ) Notice: Subject to any disclaimer, the term of this patent is extended or adjusted under 35 U.S.C. 154(b) by 0 days.

(21) Appl. No.: 15/466,607

(22) Filed: Mar. 22, 2017

(51) Int. Cl.
*A63B 69/36* (2006.01)
*A63B 69/00* (2006.01)
*A63B 102/18* (2015.01)

(52) U.S. Cl.
CPC ..... *A63B 69/00* (2013.01); *A63B 69/0002* (2013.01); *A63B 69/3608* (2013.01); *A63B 69/3623* (2013.01); *A63B 2069/0008* (2013.01); *A63B 2102/182* (2015.10)

(58) Field of Classification Search
USPC ..... 473/207, 212–214, 219, 226, 227, 229, 473/231, 276, 409, 461, 464
See application file for complete search history.

(56) References Cited

U.S. PATENT DOCUMENTS

| | | | | |
|---|---|---|---|---|
| 6,863,616 | B2 | 3/2005 | Snyder et al. | |
| 7,156,748 | B2 * | 1/2007 | Burke | A63B 69/0059 473/207 |
| 7,648,422 | B2 * | 1/2010 | Brooks | A63B 69/0059 473/215 |
| 2003/0178773 | A1 * | 9/2003 | Meyer | A63B 69/0059 273/276 |

* cited by examiner

*Primary Examiner* — Nini Legesse
(74) *Attorney, Agent, or Firm* — Parsons Behle & Latimer

(57) ABSTRACT

A swing training apparatus includes an upper line from an upper assembly to a housing of a lower assembly. A first line extendable from the housing may be connected to a sporting implement. A second line extendable from the housing may be connected to the upper line. A first spool, second spool, lever, and pawl are located within the housing. The rotation of the first spool permits the extension of the first line. The pawl is biased to prevent the rotation of the first spool. Tension in the second line cause the rotation of the second spool, causing the lever to engage a portion on the pawl to disengage the pawl and permit extension of the first line. The first and second spools, lever, and pawl are configured to permit the extension of the first line at the proper "release" point during the swing of a sporting implement.

21 Claims, 8 Drawing Sheets

SWING TRAINING DEVICE

BACKGROUND

Field of the Disclosure

The embodiments described herein relate to a swing training device that teaches a user the proper "release" point during a swing. The swing training device may be used to train a user the proper "release" point during a swing for various sports, such as, but not limited to golf, baseball, and softball.

Description of the Related Art

Baseball and softball are popular sports. One aspect of becoming a good baseball or softball player is perfecting the swing to "release" the wrists at the proper point during the swing to provide maximum force to the ball. Learning this technique can be rather difficult and may frustrate players learning the sport. A need exists to provide an apparatus that aids in teaching the proper "release" point during a swing.

Golf is also a popular sport, but one obstacle in becoming a proficient golfer is mastering a consistent golf swing. Over the years there have been many advancements in golf club and golf ball technology that help a golfer to hit golf balls in a straight or intended direction. However, a golfer who lacks a proper, consistent golf swing may not perform up to internal expectations even with these technological advancements, which may lead to disappointment, frustration, and even the possibility that the golfer may give up on the game of golf.

An improper golf swing is prevalent among golfers, young and old, beginners and veterans. One possible difficulty in learning the proper swing is that often it is hard to translate theory into practice. Even the smallest incorrect movement during golf swing can be crucial. One critical movement in a golf swing is "releasing" the wrists at the correct time. Golfers, both beginners and veterans, may not even realize that they are "releasing" their wrists too early or too late in their swing. A golf professional may recognize such a mistake in a golfer's swing, but correcting the problem may not be easy as it is difficult to teach the exact point during the swing that the wrists should be "released."

One key to hitting a golf ball is developing a golf swing that permits the club to strike the golf ball with the greatest generated force, but so that the club hits the ball as "squarely" as possible. This requires the golfer to perform the entire swing correctly. During a swing, it is important to keep the trailing wrist bent during the swing until the point where the club head is within approximately 18 inches away from the ball. At that point, the wrists should "release" and the trailing arm should start to straighten out thereby creating a "sling-shot" effect. The timing of the wrist "release" not only affects the impact force, it also affects the accuracy. Accordingly, there is a need for a training device and method of training to assist a golfer in the development of proper swing technique and "wrist and arm release" to achieve a consistently repeatable and effective golf swing.

U.S. Pat. No. 6,863,616 to Snyder et al. ("Snyder"), which is incorporated by reference herein in its entirety, recognized this problem and discloses a device intended to train a golfer to learn the proper point in a swing to "release" the wrists. Snyder discloses a training device that uses a trigger line to release a ratchet wheel, which is connected to a ratchet line that is connected to a golf club. The device of Snyder is intended to "release" the ratchet at the proper time during the correct swing. The device of Snyder has some deficiencies. A device training a golfer the proper release point needs to provide a consistent mechanism that has same repeatable release point. The trigger line of Snyder is attached to the ratchet mechanism, locking and releasing the ratchet line. Both of these lines apply opposing forces to the ratchet wheel of Snyder. As the ratchet wheel returns to the initial position after a swing the "pull" of the trigger line varies to release the ratchet wheel, which in turn varies the "release" point on subsequent swings. Therefore, Snyder does not always provide a consistent "release" point. An improved training device is desirable.

Additional disadvantages of Snyder and other current training devices may exist.

SUMMARY

The present disclosure is directed to a swing training devices that addresses some of the problems and disadvantages discussed above.

One embodiment of a swing training apparatus comprises an upper assembly having a connector configured to connect an upper portion of a user's arm and an upper line that extends from the upper assembly. The apparatus comprises a lower assembly having a housing and a connector configured to connect to a forearm portion of the user's arm. A first line is extendable from a first end of the housing, an end of the first line being configured to selectively connect to a sporting implement. A second line is extendable from a second end of the housing and an end of the second line of the lower assembly being connectable to the upper line. The apparatus includes a first spool having teeth along an exterior, a portion of the first line being wrapped around the first spool within the housing, wherein rotation of the first spool in a first direction retracts the first line into the housing and rotation of the first spool in a second direction permit the first line to unspool off the first spool.

The apparatus comprises a pawl that selectively engages the teeth of the first spool to prevent rotation of the first spool and a second spool having teeth along an exterior, a portion of the second line being wrapped around the second spool within the housing. The apparatus comprises a lever positioned adjacent to the pawl, wherein rotation of the second spool in a first direction retracts the second line into the housing and the lever ratchets on the second spool and wherein tension in the second line of the lower assembly rotates the second spool in a second direction and the teeth on the second spool engage the lever to move the lever to engage a portion of the pawl to disengage the pawl from the teeth of the first spool.

The second spool may move the lever to an engagement point of the pawl prior to the pawl being disengaged from the teeth of the first spool. The lever may engage a projection on the pawl to disengage the pawl from the teeth of the first spool. The apparatus may include a first spring the biases the pawl into engagement with the teeth of the first spool and a second spring that biases the lever to engagement with the second spool and the portion of the pawl. The apparatus may include a third spring that biases the first spool to retract the first line of the lower assembly and a fourth spring that biases the second spool to retract the second line of the lower assembly.

The connector of the upper assembly may include an adjustable strap and the connector of the lower assembly may include at least two adjustable straps connected to a lower portion of the housing. The pawl and lever may pivot about the same pivot point. The apparatus may include a clip connected to the end of the first line. The clip may be configured to be selectively connected to a shaft of a golf club. The clip may be configured to be selectively connected to a ring positioned on a portion of a bat.

One embodiment of a swing training apparatus comprises an upper assembly having a connector configured to connect to an upper portion of a user's arm, an upper line having a first end and a second end, and an adjusting unit, the adjusting unit configured to vary a length that the first end of the upper line ends from the adjusting unit. The apparatus comprises a lower assembly having a housing, a connector configured to connect to the user's forearm, a first line extendable from a first end of the housing, and a second line extendable from a second end of the housing, the first end of the housing being opposite of the second end of the housing. The apparatus includes a first spool having teeth along an exterior of the spool, a portion of the first line being wrapped around the first spool within the housing, a pawl that selectively engages the teeth of the first spool, and an end of the second line of the lower assembly being connected to the first end of the upper line, wherein rotation of the first spool permits the extension of the first line from the housing and wherein tension in the second line of the lower assembly permits rotation of the first spool.

The connector of the upper assembly may include an adjustable strap and the connector of the lower assembly may be at least two adjustable straps connected to a lower portion of the housing. The upper line of the upper assembly may be a chain, string, cord, or wire. The adjusting unit may include a rotatable knob, the rotation of the knob adjusting the length that the first end of the chain extends from the upper assembly. Tension in the second line of the lower assembly may selectively disengage the pawl from the teeth of the first spool to permit rotation of the first spool. The apparatus may include a second spool having teeth on an exterior within the housing the lower assembly, a portion of the second line being wrapped around the second spool within the housing. The apparatus may include a lever positioned adjacent to the pawl, wherein rotation of the second spool in a first direction retracts the second line into the housing and the lever ratchets on the second spool and wherein tension in the second line of the lower assembly rotates the second spool in a second direction and the teeth of the second spool engage the lever to move the lower towards engagement with the pawl to selectively disengage the pawl from the teeth of the first spool.

One embodiment is a method comprising providing an upper assembly configured to be connected to an upper portion of a user's arm and providing a lower assembly configured to be connected to a forearm portion of the user's arm. The method comprises providing a first line from the lower assembly that is connectable to a sporting implement, wherein a portion of the first line is spooled around a portion of a first spool within the lower assembly, a pawl selectively prevents the first spool from rotating. The method comprises providing a second line form the lower assembly that is connectable to the upper assembly, wherein a portion of the second line is spooled around a portion of a second spool within the lower assembly, the rotation of the second spool in a first direction retracts the second line into the lower assembly and ratchets a lever along the spool and the rotation of the second spool in a second direction moves the lever towards engagement of the pawl. Wherein tension in the second line of the lower assembly moves the second spool in the second direction and moves the lever to engage a portion of the pawl to selectively disengage the pawl form the first spool permitting the first spool to rotate.

The method may comprise providing an upper line from the upper assembly that is connectable to the second line. Alternatively, the second line may be connected directly to the upper assembly. The method may comprise providing an adjusting unit that is configured to vary a length of the upper line from the upper assembly. The adjusting unit may include a knob that is configured to rotate to adjust the length of the upper line or to adjust the length of the second line if the second line is connected directly to the adjusting unit. The knob may be disengaged to align a reference indicator of the upper line length.

Figure 1:
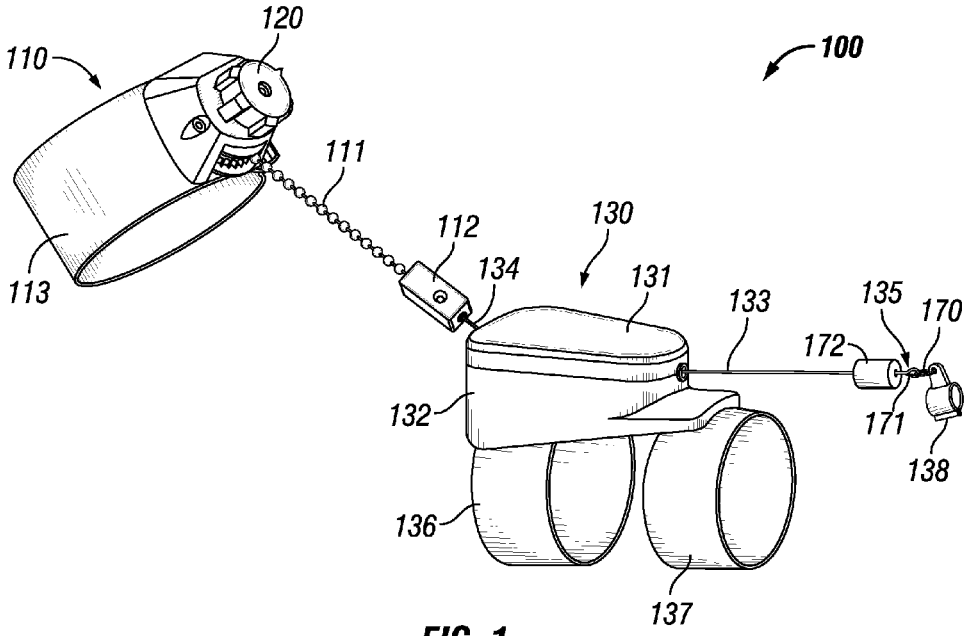
FIG. 1 shows an embodiment of a swing training device.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a swing training apparatus 100. The apparatus 100 may be used in combination with various sporting implements to train the user the proper "release" point during the swing as discussed herein. The apparatus 100 includes an upper assembly 110 and a lower assembly 130. The upper assembly 110 includes a connector that is configured to connect the upper assembly 110 to an upper portion of a user's arm. Various connectors may be used to connect the upper assembly 100 to the arm. For example, the connector may be an adjustable strap 113, as shown in FIG. 1. However, various other connectors may be used such as, but not limited to, a sleeve, elastic strap, ties, and hook and loop fasteners. The upper assembly 110 may include an adjustment unit 120 that is used to adjust a length of an upper line 111 that extends away from the upper assembly 110 and the adjustment unit 120. The upper line 111 may be a chain as illustrated in FIG. 1, but the upper line could be varied as would be appreciated by one of ordinary skill in the art having the benefit of this disclosure. For example, the line could be, but is not limited to, a wire, string, cord, or the like.

The lower assembly 130 includes a housing and at least one connector that is configured to connect the lower assembly to a forearm portion of a user's arm. The connector may comprises two adjustable straps 136, 137 as shown in FIG. 1. Various other connectors may be used such as, but not limited to, a sleeve, elastic strap, and a tie. The lower assembly 130 includes a housing that may be comprised of an upper housing 131 and a lower housing 132. A first line 133 is extendable from a first end of the housing and a second line 134 is extendable from a second end of the housing that is opposite of the first end. The first line 133 includes a connector 170 positioned on the end 135 of the first line 133 that is configured to connect to a clip 138 that may selectively connect the first line 133 to the shaft of an implement, such as a golf club, as discussed herein. The connector 170 may be connected to a loop 171 located at the end 135 of the first line 133. A bumper 172 may be provided adjacent to the end 135 of the first line 133 to protect the housing 131, 132 when the first line is retracted into the housing 131, 132 as discussed herein. The second line 134 is selectively connectable to the upper line 111 of the upper assembly 110 via a connector 112. The end 135 of the first line 133 may be connected to the clip 138 by various mechanisms as would be appreciated by one of ordinary skill in the art having the benefit of this disclosure. For example, a slip ring 170 may be used to connect the end 135 of the first line 133 to the clip 138 via a loop 171 as shown in FIG. 1.

Figure 2:
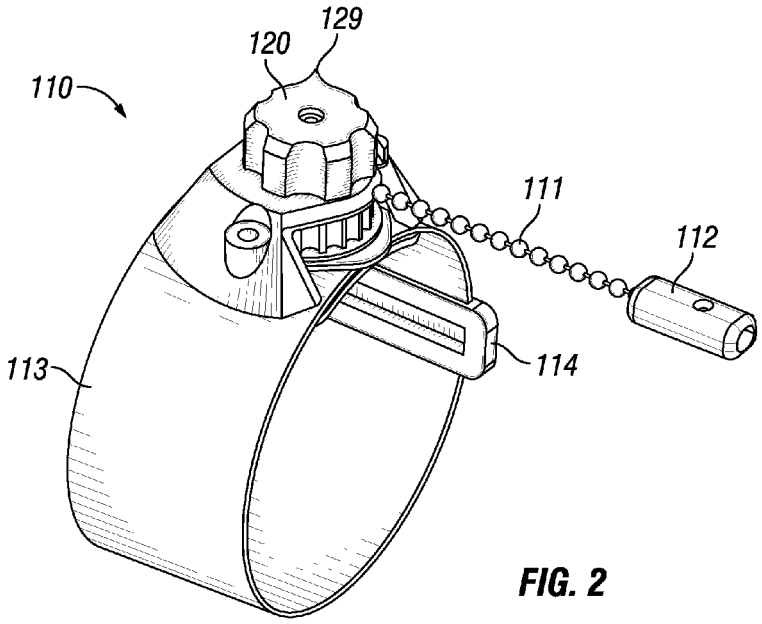
FIG. 2 shows an embodiment of an upper assembly of a swing training device.

FIG. 2 shows an embodiment of an upper assembly 110 of a swing training device. The upper assembly 110 includes a connector, strap 113, that is configured to selectively connect the upper assembly 110 to a portion of a user's arm. The strap 113 includes a buckle 114 that may be used to adjust the size of the strap 113 to accommodate different sizes of user's arms. An upper line, chain 111, extends away from a portion of the upper assembly 110. An adjusting unit 120 may be used to adjust the length of the upper line 111 that extends away from the upper assembly 110, which may be used to conform to different users and to adjust the "release" point during a swing for various skill levels as discussed herein. A connector 112 may be used to selectively connect the upper line 111 with the second line 134 (shown in FIG. 1) of the lower assembly 130 (shown in FIG. 1).

Figure 3:
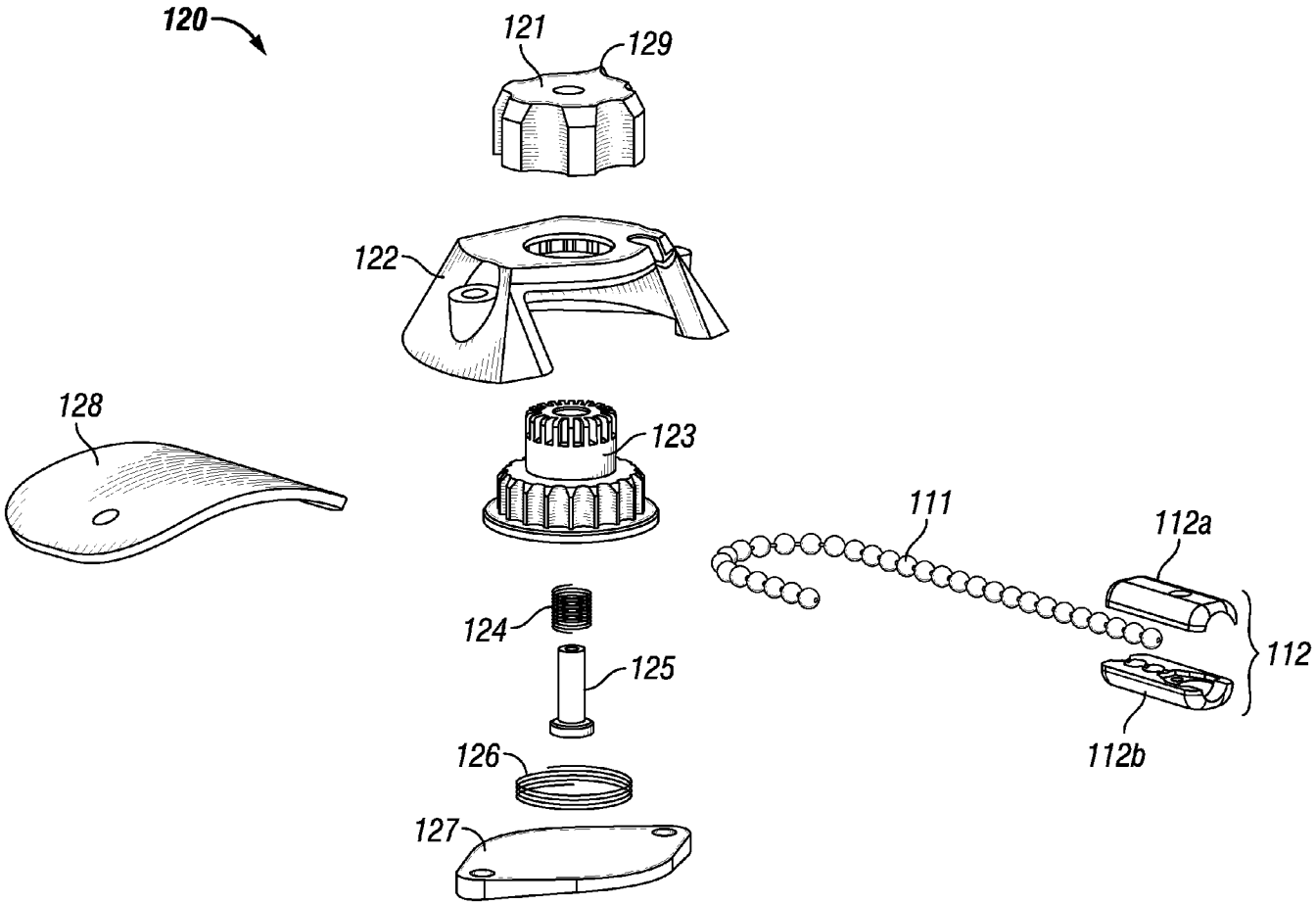
FIG. 3 shows an exploded view of a portion of the upper assembly of FIG. 2.

FIG. 3 shows an exploded view of an embodiment of an adjustment unit 120 of the upper assembly 110. The adjustment unit 120 includes a chain drive 123 mounted within a housing 122. The housing 122 is mounted to a base plate 127 and a plate 128 positioned on the inside of the strap 113 (shown in FIG. 2) of the upper assembly 110. The strap 113 (shown in FIG. 2) is captured between base plates 127, 128 connecting the upper assembly 110 to the strap 113. A knob 121 is connected to stem 125 and engages the chain drive 123 and spring 126, and may be used to rotate the chain drive 123 to shorten or lengthen the length of the upper line 111 that extends away from the upper assembly 110 (shown in FIG. 2) by displacement of spring 126, the stem 125, and spring 124 positioned within a central bore of the chain drive 123. The knob 121 is turned independent of the chain drive by displacement of stem 125 and spring 124. The adjustment unit 120 of the upper assembly 110 includes a connector 112 that may be used to selectively connect the upper line 111 with the second line 134 (shown in FIG. 1) from the lower assembly 130. One embodiment of the connector 112 includes a first half 112*a* and a second half 112*b* that may be connected together to capture the upper line 111 and the second line 134 (shown in FIG. 1). The connector may capture or connect to a connector 160 (shown in FIG. 4) positioned on the end of the second line 134. Various connectors may be used to selectively connect the upper line 111 to the second line 134 as would be appreciated by one of ordinary skill in the art having the benefit of this disclosure.

The adjusting unit 120 of the upper assembly may be configured so that the knob 121 locks in a neutral or initial position. The user may need to push down on the knob 121 to turn the knob 121 to lengthen or shorten chain 111. The knob 121 may include a reference indicator such as a pointer 129 or similar structure that may be used as a reference for the user of the device. The knob 121 may be configured so that the user can lift the knob 121 and turn to locate the pointer 129 for reference to the initial position of the chain 111. The length of chain 111 determines the release point during the swing as discussed herein. The pointer 129 may be used by reference for the user in regards to adjustments to the length of chain 111 to designate various skill levels of the user. Alternatively, the second line 134 (shown in FIG. 1) of the lower assembly 130 may be connected directly to the adjusting unit 120 as would be appreciated by one of ordinary skill in the art having the benefit of this disclosure. In other words, the second line 134 and the upper line 111 may be integrated into a single line.

Figure 4:
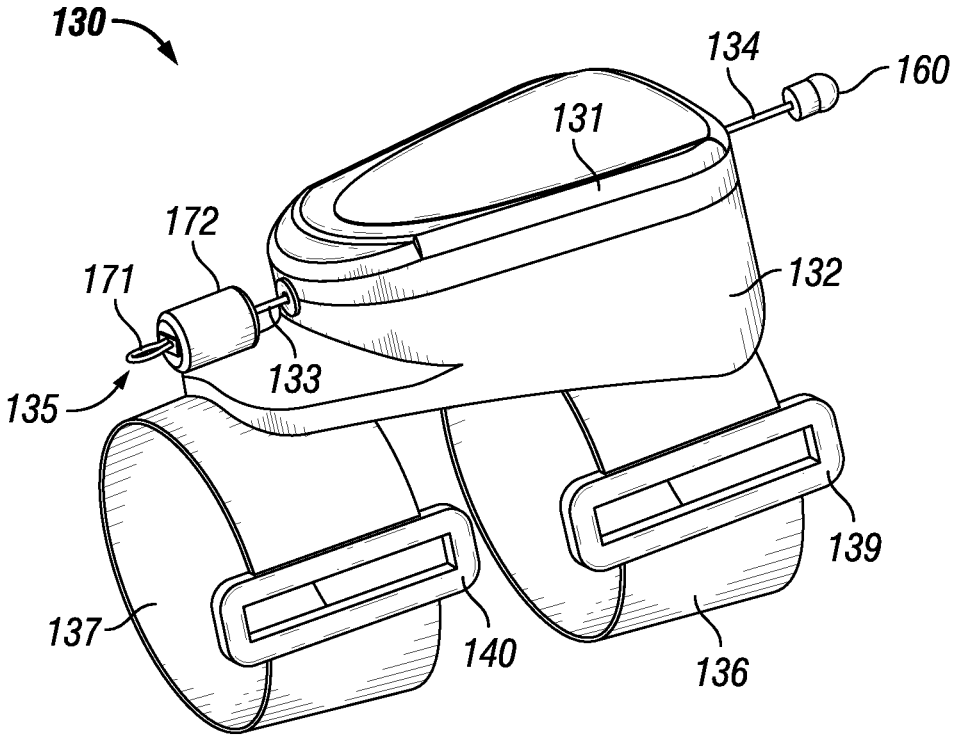
FIG. 4 shows an embodiment of a lower assembly of a swing training device.

FIG. 4 shows an embodiment of a lower assembly 130. The lower assembly 130 includes a connector configured to selectively connect the lower assembly 130 to the forearm of a user. The connector may be two adjustable straps 136,137 as shown in FIG. 4. The size of the straps 136, 137 may be adjusted via buckles 139, 140. Various other connectors may be used to selectively connect the lower assembly 130 to the forearm of a user as would be appreciated by one of ordinary skill in the art having the benefit of this disclosure. A first line 133 is extendable from a first end of the housing of the lower assembly 130. The housing may be comprised of an upper housing 131 connected to a lower housing 132, collectively referred to herein as the housing. The housing may comprise other configurations as would be appreciated by one of ordinary skill in the art having the benefit of this disclosure. The end 135 of the first line 133 may include a loop 171 that is configured to connect to a clip 138 (shown in FIG. 1) that may be selectively attached to a shaft of a sporting implement, such as a golf club or a bat. A second line 134 is extendable from a second end of the housing and the end of the second line 134 includes a connector 160. The connector 160 may be connected to a first end of the upper line 111 (shown in FIG. 2) from the upper assembly 110 via a connector 112 as discussed herein.

Figure 5:
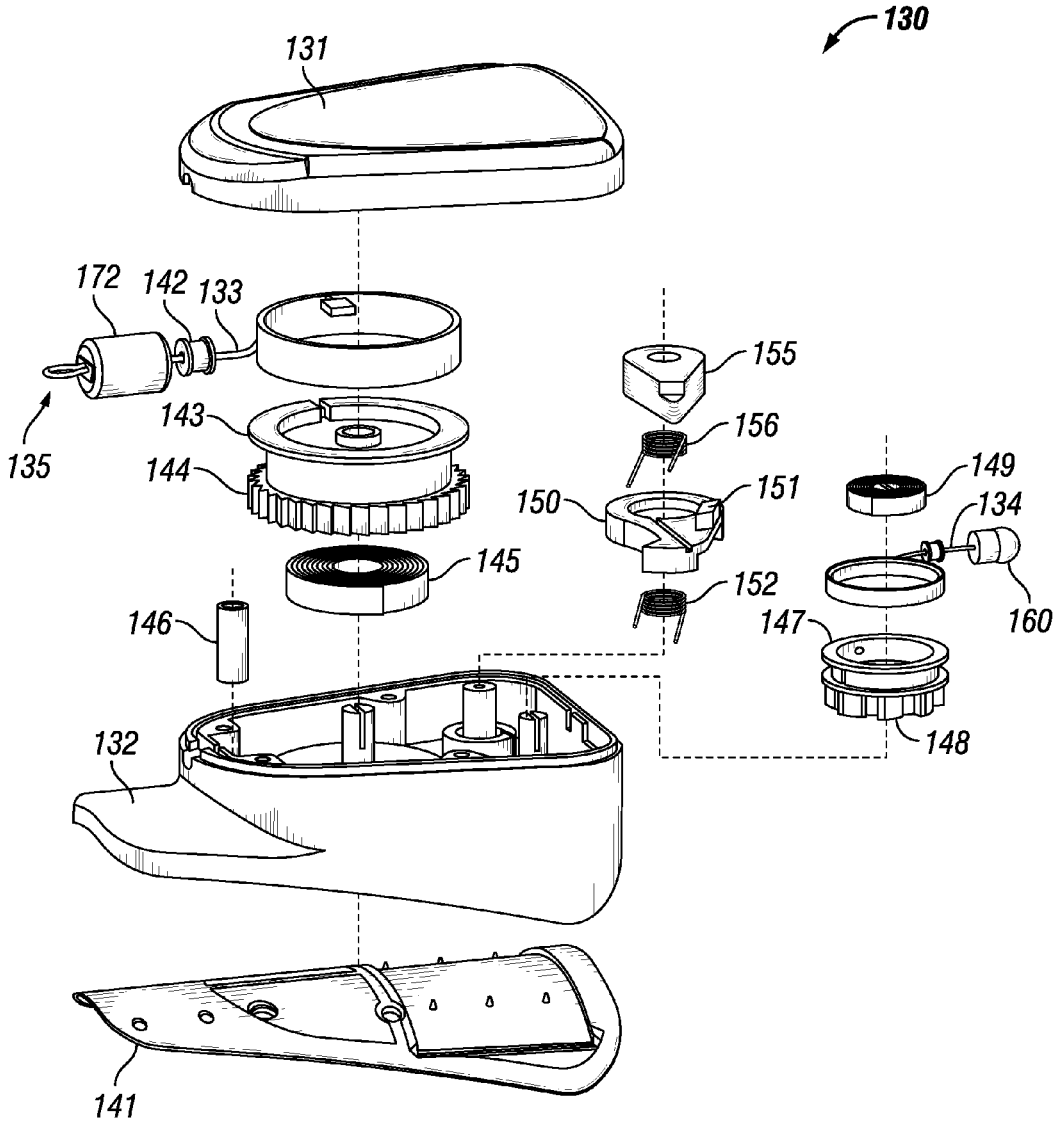
FIG. 5 shows an exploded view of a portion of the lower assembly of FIG. 4.

FIG. 5 shows an exploded view of the housing comprised of upper housing 131, lower housing 132, and base 141, collectively referred to as the housing, of the lower assembly 130. The straps 136, 137 of the lower assembly 130 may be secured between the lower housing 132 and the base 141. The base 141 may be removed from the lower housing 132 to permit the replacement of the straps 136, 137 with different straps. Positioned within the housing is a first spool 143 that includes teeth 144 on at least a portion of the exterior of the spool 143. A spring 145 spring loads the first spool 143 and biases the first spool 143 to an initial position. A first line 133 is spooled around the first spool 143. The housing includes a bushing 146 to aid in aligning the first line 133 it passes through a grommet 142 to exit the housing. The end 135 of the first line 133 may be formed in a loop 171 that is configured to connect to a clip 138 (shown in FIG. 1)

via a connector 170 and a bumper 172 is positioned adjacent to the end 135 of the first 133 to protect the lower assembly 130, as discussed herein.

Positioned within the housing is a second spool 147 that includes teeth 148 on at least a portion of the exterior and a spring 149 that spring loads the second spool 147 and biases to an initial position. A second line 134 is spooled around the second spool 147. The second line 134 extends out of the housing and includes a connector 160 on the end of the second line 134. A pawl 150 is positioned within the housing and spring 152 biases the pawl 150 into engagement with the teeth 144 of the first spool 143 to selectively prevent rotation of the first spool 143 and extension of the first line 133. Positioned within the housing is a lever 155 that is positioned adjacent to the pawl 150. The lever 155 is configured to selectively engage the second spool 147 and the spring 156 biases the lever 155 to engagement with the teeth 148 of the second spool 147. Rotation of the second spool 147 in one direction may engage lever 155 and the lever 155 may "slip" over the teeth 148 when the second spool 147 rotates in the opposite direction. The lever 155 is configured to selectively engage a portion of the pawl 150 as discussed herein. Spring 156 biases the lever 155 to an initial position in which the lever 155 will engage or ratchet teeth 148 of second spool 147. Various configurations of the pawl 150 and lever 155 may exists so that movement by the lever 155 may engage a portion of the pawl 150. For example, the pawl 150 may include a pin, teeth, or projection 151 that the lever 155 selectively engages as illustrated in FIG. 5. The lever 155 is selectively pivoted by the second spool 147 to engage the projection 151 to pivot the pawl 150 away from the first spool 143 to selectively permit the rotation of the first spool 143 and extension of the first line 133 as disclosed herein.

Figure 6:
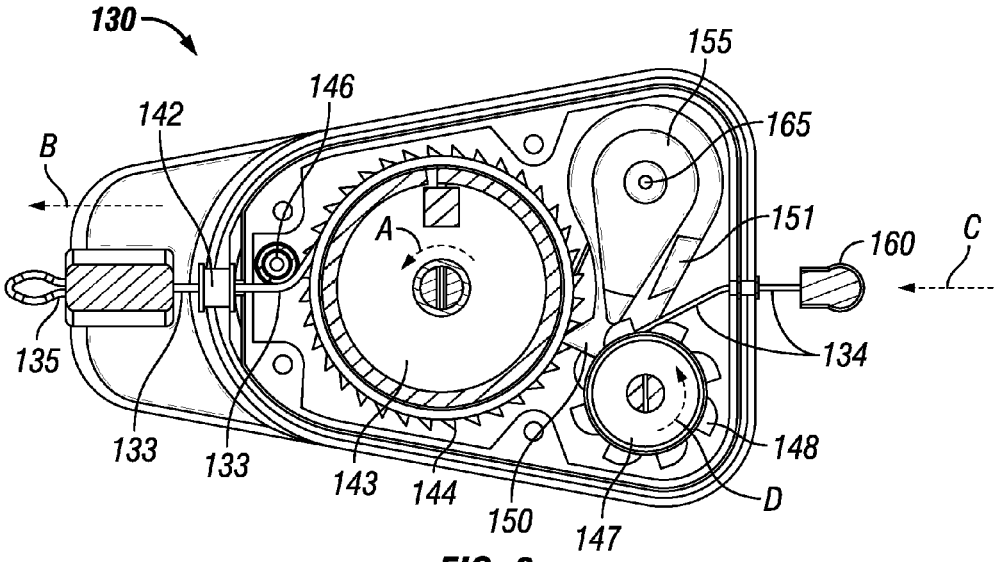
FIG. 6 shows an initial configuration of the internal mechanisms of an embodiment of a lower assembly of a swing training device.
Figure 7:
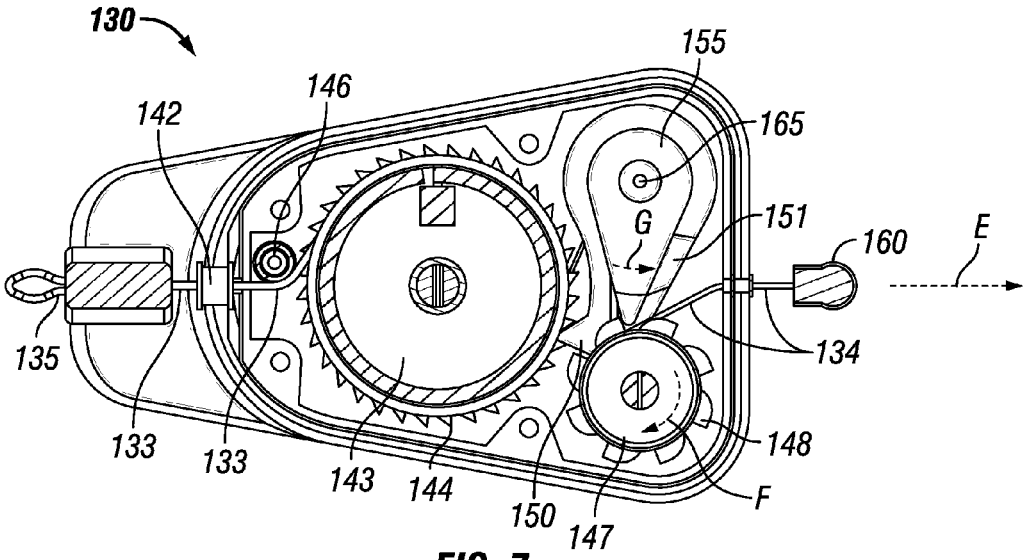
FIG. 7 shows the configuration of the internal mechanisms of FIG. 6 during a downward swing.
Figure 8:
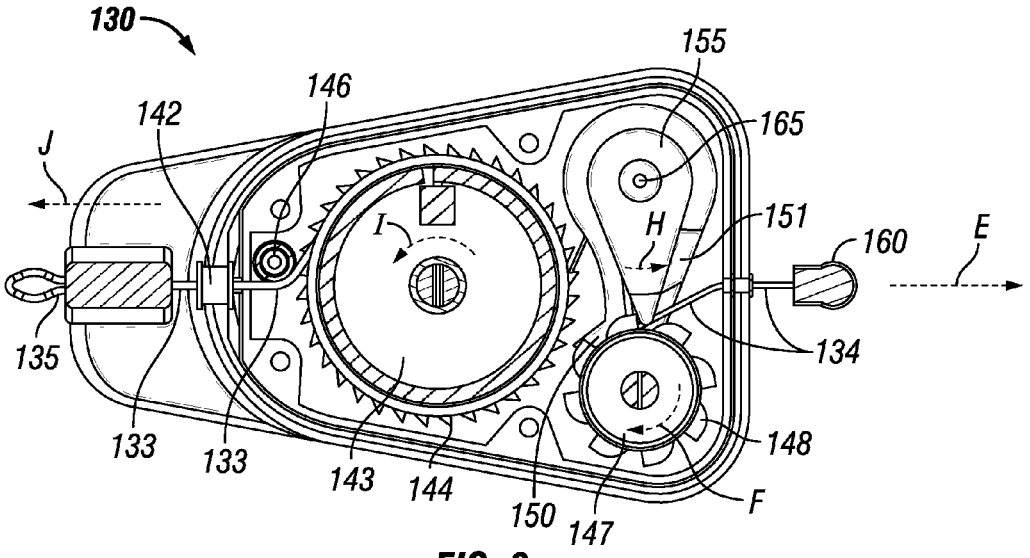
FIG. 8 shows the configuration of the internal mechanisms of FIG. 6 when the first spool is released.
Figure 9:
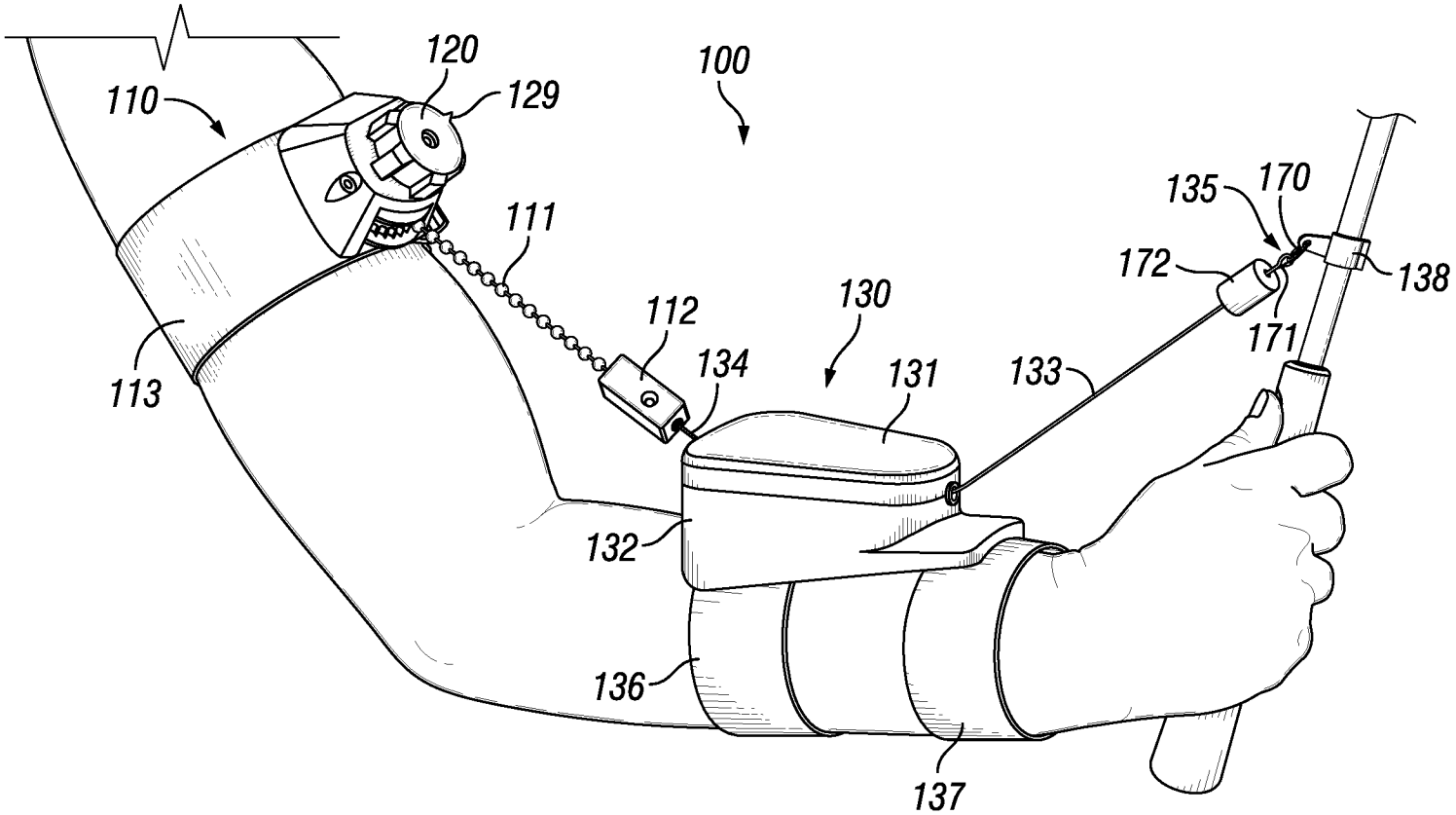
FIG. 9 shows a schematic of an embodiment of a golf swing training device positioned on a user's arm.

FIGS. 6-8 shows top views of the inside of the housing with the upper housing 131 removed for illustrated purposes. When using the swing training device, the upper assembly 110 and lower assembly 120 will be positioned on a user's upper arm and forearm respectively. The second line 134 will be connected to the upper line 111 and with the arm in a substantially straight position the user will be able to extend the first line 133 as there is tension on the second line 134 and connect the first line 133 to a shaft of an implement, such as a golf club via connector 170 and clip 138 as shown in FIG. 9. The tension in the second line 134 rotates the second spool 147 in a clockwise direction. As the second spool 147 rotates in a clockwise direction the teeth 148 of the second spool 147 engage the lever 155 which pivots away from the first spool 143 about pivot point 165 and engages the projection 151 of the pawl 150. As the lever 155 continues to pivot away from the first spool it will cause the pawl 150 to also pivot away from the first spool 143 about pivot point 165 via engagement with the projection 151. The pivoting of the pawl 150 disengages the pawl 150 from the teeth 144 of the first spool 143 permitting the first spool 143 to rotate in a counter clockwise direction (indicated by arrow A). The first line 133 may then be extended outward (indicated by arrow B) so that it may be attached to a shaft of a sporting implement.

FIG. 6 illustrates the components within the housing in an initial configuration after first line 133 has been connected to the shaft of a sporting implement as the user starts a back swing. During the back swing, the user bends his or her elbow causing the second line 134 be retracted into the housing (indicated by arrow C) by the counter clockwise rotation of the second spool 147 (indicated by arrow D). The lever 155 ratchets as the second spool 147 rotates in a counter clockwise direction and the pawl 150 remains engaged with the teeth 144 of the first spool 143 selectively preventing the rotation of the first spool 143 in a counter clockwise rotation. In addition, the first spool 143 is free to run in the clockwise direction as the user's wrist is angled.

FIG. 7 illustrates the components within the housing at the start of the downward swing of a sporting implement, such as a golf club. During the downward swing, the elbow of the user's arm opens up, which pulls on the second line 134 (indicated by arrow E) that is connected to the upper line 111 of the upper assembly 110. The tension on the second line 134 causes the second spool 147 to rotate in a clockwise direction (indicated by arrow F). The teeth 148 on the second spool 147 are configured to cause the lever 155 to ratchet when rotating in the counter clockwise direction, but are configured to engage the lever 155 when rotating in the clockwise direction. The engagement of the teeth 148 with the lever 155 pivots the lever 155 away from the first spool 143 about the pivot point 165 (indicated by arrow G). As the lever 155 first begins to pivot away from the first spool 143, the pawl 150 remains engaged with the teeth 144 of the first spool 143 preventing the first spool 143 from rotating counter clockwise, which prevents the first line 133 from extending out of the housing. This prevents the user from "releasing" his or her wrists during the downward swing too early.

FIG. 8 illustrates the components within the housing at the point of the downward swing of a sporting implement, such as a golf club, that the user should "release" his or her wrists. At the proper point during the downward swing, the lever 155 engages the projection 151 of the pawl 150 and the pawl 150 and lever 155 pivot together away from the first spool 140 (indicated by arrow H), which disengages the pawl 150 from the teeth 144 of the first spool 143. With the pawl 150 disengaged, the first spool 143 is free to rotate in a counter clockwise direction (indicated by arrow I), which permits the first line 133 to unspool off the first spool 143 extend out of the housing (indicated by arrow J). The selective releasing of the first spool 143 will provide the user with the proper point along the downward swing to "release" his or her wrists. A proper swing by the user will result in the clip 138 remaining on the shaft of the sporting implement, which may be a golf club or bat. An improper swing will result in the clip 138 to "pop off" of the shaft of the implement being swung. The "pop off" provides both a physical and audible indication to the user concerning the improper swing. The adjustment unit 120 of the upper assembly 110, as described herein, permits the "release" point to be turned to allow a higher level of skill to be obtained by the user. The interaction of the pawl 150, lever 155, and second spool 147 permit the apparatus 100 to "release" accurately at the proper point during repeated swings.

FIG. 9 shows the swing training apparatus 100 in conjunction with a golf club positioned on a user's arm. The upper assembly 110 is positioned on the upper portion of the arm and the lower assembly 130 is positioned on the forearm portion of the arm. The first line 133 of the swing training apparatus 100 is connected to the shaft of a golf club via a clip 138. A connector 170 connects a loop 171 at the end of the first line 133 to the clip 138. The adjustment unit 120 may be used to lengthen or shorten the upper line 111 to make fine adjustments to the "release" point during a downward swing of a golf club.

Figure 10:
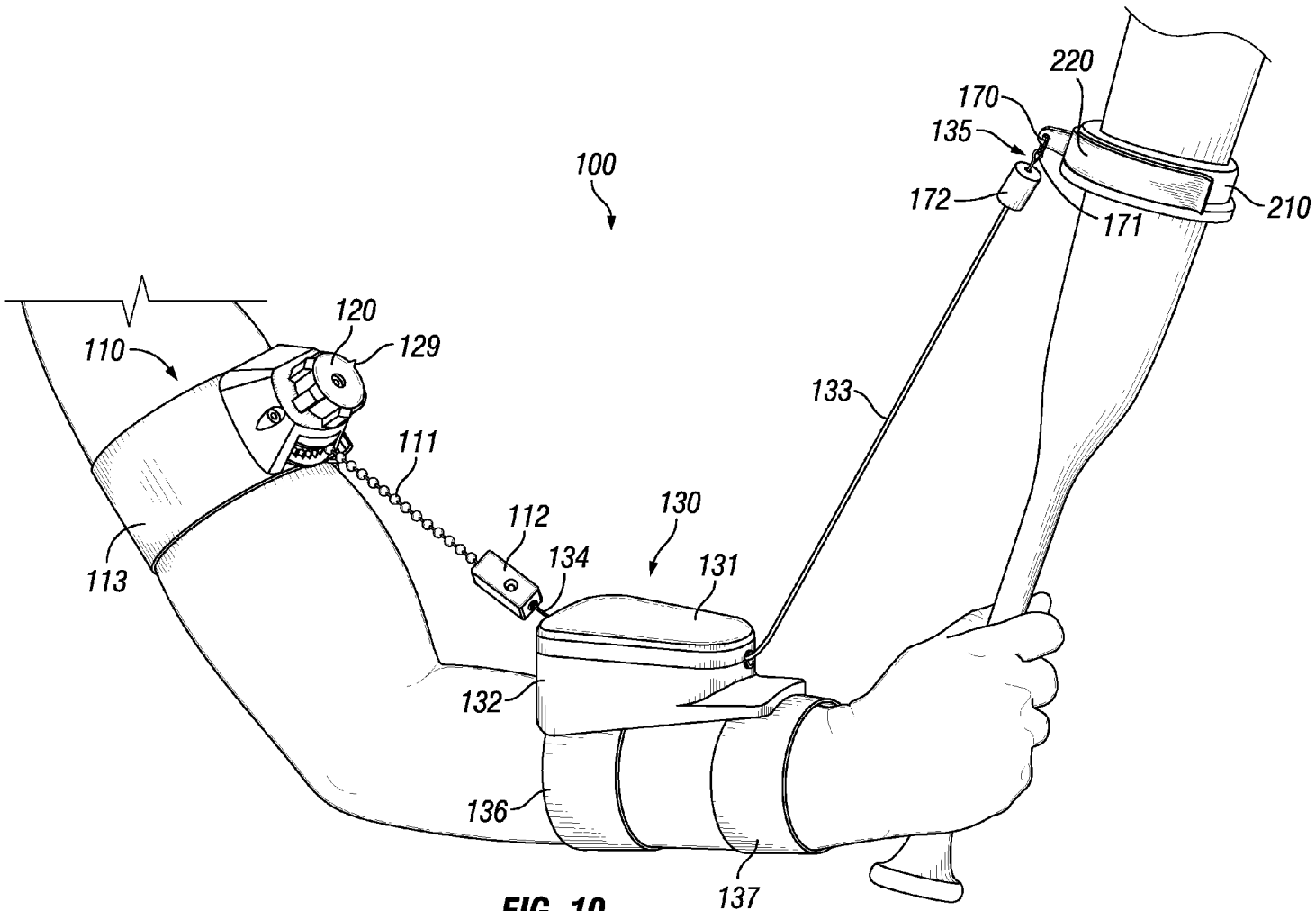
FIG. 10 shows a schematic of an embodiment of a baseball or softball swing training device positioned on a user's arm.

FIG. 10 shows the swing training apparatus 100 in conjunction with a baseball or softball bat positioned on a user's arm with the upper assembly 110 positioned on the upper portion of the arm and the lower assembly 130 positioned on the forearm portion of the arm. The first line 133 of the swing training apparatus 100 is connected to a baseball bat via a ring or doughnut 210 and clip 220. The doughnut 210 may be slid over the end and down the bat until tight on the shaft of the bat. Clip 220 may then be secured around the doughnut 210. A connector 170 connects a loop 171 at the end of the first line 133 to the clip 220. As discussed herein, the adjustment unit 120 may be used to lengthen or shorten the upper line 111 to make fine adjustments to the "release" point during a swing of the bat.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A swing training apparatus comprising:

an upper assembly having a connector configured to connect to an upper portion of a user's arm and an upper line that extends from the upper assembly; and a lower assembly having:

a housing, a connector configured to connect to a forearm portion of the user's arm, a first line extendable from a first end of the housing, an end of the first line configured to selectively connect to a sporting implement, a second line extendable from a second end of the housing, the first end of the housing being opposite of the second end of the housing and an end the second line of the lower assembly being connectable to the upper line, a first spool having teeth along an exterior, a portion of the first line being wrapped around the first spool within the housing, wherein rotation of the first spool in a first direction retracts the first line into the housing and rotation of the first spool in a second direction permits the first line to unspool off the first spool, a pawl that selectively engages the teeth of the first spool to prevent rotation of the first spool, a second spool having teeth along an exterior, a portion of the second line being wrapped around the second spool within the housing; and a lever positioned adjacent to the pawl;

wherein rotation of the second spool in a first direction retracts the second line into the housing and the lever ratchets on the second spool, and wherein tension in the second line of the lower assembly rotates the second spool in a second direction and the teeth of the second spool engage the lever to move the lever to engage a portion of the pawl to disengage the pawl from the teeth of the first spool.

2. The swing training apparatus of claim 1, wherein second spool moves the lever to an engagement point of the pawl prior to the pawl being disengaged from the teeth of the first spool.

3. The swing training apparatus of claim 1, wherein lever engages a projection on the pawl to disengage the pawl from the teeth of the first spool.

4. The swing training apparatus of claim 1, further comprising a first spring that biases the pawl into engagement with the teeth of the first spool and a second spring that biases the lever to engagement with the second spool and the portion of the pawl.

5. The swing training apparatus of claim 4, further comprising a third spring that biases the first spool to retract the first line of the lower assembly and a fourth spring that biases the second spool to retract the second line of the lower assembly.

6. The swing training apparatus of claim 1, wherein the connector of the upper assembly further comprises an adjustable strap and the connector of the lower assembly further comprises at least two adjustable straps connected to a lower portion of the housing.

7. The swing training apparatus of claim 1, wherein the pawl pivots about a pivot point and the lever pivots about the same pivot point.

8. The swing training apparatus of claim 1, further comprising a clip connected to the end of the first line.

9. The swing training apparatus of claim 8, wherein the clip is configured to be selectively connected to a shaft of a golf club.

10. The swing training apparatus of claim 8, wherein the clip is configured to be selectively connected to a ring positioned on a portion of a bat.

11. A swing training apparatus comprising:

an upper assembly having a connector configured to connect to an upper portion of a user's arm, an upper line having a first end and a second end, and an adjusting unit, the adjusting unit configured to vary a length that the first end of the upper line extends from the upper assembly; and a lower assembly having a housing, a connector configured to connect to the user's forearm, a first line extendable from a first end of the housing, and a second line extendable from a second end of the housing, the first end of the housing being opposite of the second end of the housing, a first spool having teeth along an exterior of the spool, a portion of the first line being wrapped around the first spool within the housing, a pawl that selectively engages the teeth of the first spool, and an end of the second line of the lower assembly being connected to the first end of the upper line, wherein rotation of the first spool permits the extension of the first line from the housing and wherein tension in the second line of the lower assembly permits rotation of the first spool.

12. The swing training apparatus claim 11, wherein the connector of the upper assembly further comprises an adjustable strap and the connector of the lower assembly further comprises at least two adjustable straps connected to a lower portion of the housing.

13. The swing training apparatus of claim 11, wherein the upper line of the upper assembly further comprises a chain, string, cord, or wire.

14. The swing training apparatus of claim 13, wherein the adjusting unit further comprises a rotatable knob, the rotation of the knob adjusting the length that the first end of the chain extends from the upper assembly.

15. The swing training apparatus of claim 11, wherein tension in the second line of the lower assembly selectively disengages the pawl from the teeth of the first spool to permit rotation of the first spool.

16. The swing training apparatus of claim 15 further comprising:

a second spool having teeth on an exterior within the housing of the lower assembly, a portion of the second line being wrapped around the second spool within the housing;

a lever positioned adjacent to the pawl;

wherein rotation of the second spool in a first direction retracts the second line into the housing and the lever ratchets on the second spool, and wherein tension in the second line of the lower assembly rotates the second spool in a second direction and the teeth of the second spool engage the lever to move the lever towards engagement with the pawl to selectively disengage the pawl from the teeth of the first spool.

17. A method comprising:

providing an upper assembly configured to be connected to an upper portion of a user's arm;

providing a lower assembly configured to be connected to a forearm portion of the user's arm;

providing a first line from the lower assembly that is connectable to a sporting implement, wherein a portion of the first line is spooled around a portion of a first spool within the lower assembly, a pawl selectively prevents the first spool from rotating;

providing a second line from the lower assembly that is connectable to the upper assembly, wherein a portion of the second line is spooled around a portion of a second spool within the lower assembly, the rotation of the second spool in a first direction retracts the second line into the lower assembly and ratchets a lever along the spool and the rotation of the second spool in a second direction moves the lever towards engagement of the pawl;

wherein tension in the second line of the lower assembly moves the second spool in the second direction and moves the lever to engage a portion of the pawl to selectively disengage the pawl from the first spool permitting the first spool to rotate.

18. The method of claim 17, further comprising providing an upper line from the upper assembly that is connectable to the second line.

19. The method of claim 18, further comprising providing an adjusting unit that is configured to vary a length of the upper line from the upper assembly.

20. The method of claim 19, wherein the adjusting unit further comprises a knob that is configured to rotate to adjust the length of the upper line.

21. The method of claim 20, wherein the knob may be disengaged to align a reference indicator independent of the upper line length.

* * * * *